United States Patent [19]

Deren

[11] Patent Number: 4,885,890

[45] Date of Patent: Dec. 12, 1989

[54] MODULAR FURNACE LINING AND HARDWARE SYSTEM THEREFOR

[75] Inventor: Gary W. Deren, Tonowanda, N.Y.

[73] Assignee: STEMCOR Corporation, Cleveland, Ohio

[21] Appl. No.: 268,110

[22] Filed: Nov. 7, 1988

Related U.S. Application Data

[62] Division of Ser. No. 8,892, Jan. 30, 1987, Pat. No. 4,803,822.

[51] Int. Cl.[4] ..... F23M 5/00; E04B 1/62; E04B 1/80

[52] U.S. Cl. ..... 52/506; 110/336

[58] Field of Search ..... 52/404, 506, 507, 508, 52/509; 110/336

[56] References Cited

U.S. PATENT DOCUMENTS

| | | | |
|---|---|---|---|
| 2,879,660 | 3/1959 | Reintjes | 52/509 |
| 3,687,093 | 8/1972 | Byrd, Jr. | 110/1 A |
| 3,706,870 | 12/1972 | Sauder et al. | 219/98 |
| 3,742,670 | 7/1973 | Byrd, Jr. | 52/506 |
| 3,819,468 | 6/1974 | Sauder et al. | 161/152 |
| 3,832,815 | 9/1974 | Balaz et al. | 52/227 |
| 3,854,262 | 12/1974 | Brady | 52/404 |
| 3,892,396 | 7/1975 | Monaghan | 226/43 |
| 3,940,244 | 2/1976 | Sauder et al. | 432/247 |
| 3,952,470 | 4/1976 | Byrd, Jr. | 52/509 |
| 3,990,203 | 11/1976 | Greaves | 52/227 |
| 4,001,996 | 1/1977 | Byrd, Jr. | 52/509 |
| 4,032,742 | 6/1977 | Kendrick et al. | 219/99 |
| 4,055,926 | 11/1977 | Byrd, Jr. | 52/475 |
| 4,086,737 | 5/1978 | Byrd, Jr. | 52/227 |
| 4,103,469 | 8/1978 | Byrd, Jr. | 52/509 |
| 4,120,641 | 10/1978 | Myles | 432/3 |
| 4,123,886 | 11/1978 | Byrd, Jr. | 52/509 |
| 4,218,962 | 8/1980 | Cunningham et al. | 93/84 |
| 4,248,023 | 2/1982 | Dunlap | 52/506 |
| 4,287,839 | 9/1981 | Severin et al. | 110/331 |
| 4,324,602 | 4/1982 | Davis et al. | 156/71 |
| 4,336,086 | 6/1982 | Rast | 156/71 |
| 4,339,902 | 7/1982 | Cimochowski et al. | 52/506 |
| 4,379,382 | 4/1983 | Sauder | 52/506 |
| 4,381,634 | 5/1983 | Hounsel et al. | 52/506 |
| 4,429,504 | 2/1984 | Hounsel et al. | 52/506 |
| 4,449,345 | 5/1984 | Hounsel et al. | 52/506 |
| 4,478,022 | 10/1984 | Wilkinson et al. | 52/509 |
| 4,493,176 | 1/1985 | Cimochowski | 52/508 |
| 4,494,295 | 1/1985 | Herring | 29/432 |
| 4,516,374 | 5/1985 | Finney | 52/404 |
| 4,523,531 | 6/1985 | Bishara | 110/336 |
| 4,549,382 | 10/1985 | Byrd, Jr. | 52/506 |
| 4,574,995 | 3/1986 | Sauder et al. | 228/140 |
| 4,578,918 | 4/1986 | Yost et al. | 52/509 |
| 4,584,814 | 4/1986 | Hounsel et al. | 52/747 |
| 4,605,583 | 8/1986 | Frahme | 428/126 |

FOREIGN PATENT DOCUMENTS 895472 5/1962 United Kingdom .

OTHER PUBLICATIONS

Sauder Energy Systems Pyrobloc$^r$ E$^{tm}$ Module and Y$^{tm}$ Module advertisement, 1 page, date and source unknown.

McDermott (Babcock & Wilcox) advertisement for Weld-On Modules Saber Bloc$^{tm}$, Saber Bloc$^{tm}$II, Kao--Block.

*Primary Examiner*—John E. Murtagh

*Attorney, Agent, or Firm*—George W. Moxon, II; Joseph G. Curatolo; Larry W. Evans

[57] ABSTRACT

Attachment hardware and modular furnace lining which may be secured to an interior surface of a furnace by any one of a variety of methods. e.g., welding, self-tapping screw, or to a previously secured stud or matingly configured member. In a preferred embodiment the module is formed of refractory ceramic fiber blanket portions which are retained into a modular unit by the hardware system. Each module includes hardware having support structure which passes through the layers of blanket adjacent the furnace wall. The hardware includes a collar which is moveable relative to the base bar to allow adjustment of the position of the module and means to facilitate access from the hot face of the module to install it.

2 Claims, 4 Drawing Sheets

MODULAR FURNACE LINING AND HARDWARE SYSTEM THEREFOR

This is a division of co-pending application Ser. No. 008,892, filed Jan. 30, 1987, now U.S. Pat. No. 4,803,822.

BACKGROUND OF THE INVENTION

Field of the Invention

The present invention relates attachment hardware for modular insulation systems and more particularly to a modular ceramic fiber system in which the ceramic fiber insulation module may be readily installed by fastening through its hot face.

Modular insulation systems for furnaces kilns and the like are not of themselves novel. A wide variety of modular systems have been proposed or employed which include as a part thereof modules formed in part of ceramic fiber blanket or mat. Many of these have enjoyed great commercial success. However, there remains a need for a ceramic fiber modular insulation system which can be easily and rapidly installed by a labor force not having highly specialized skills. There further remains a need for a ceramic fiber modular insulation system in which the modules can be secured in a variety of ways according to service conditions intended and equipment available for use in effecting installation. For example, in some installations it is adequate and expedient to simply affix the modules with self tapping screws or bolts inserted into the module from its hot face. In others welding through the module is required and yet others it is desired to place the module onto the previously installed threaded studs or other support hardware previously affixed to the furnace wall. It is desired to meet these objectives in as economical manner as possible and without need of a variety of modules each designed for a particular method of attachment.

Examples of known modular ceramic fiber insulation systems include the following:

U.S. Pat. No. 3,940,244 to Sauder et al. discloses an insulation module formed of a plurality of strips of resilient fiber insulation positioned adjacent each other in side-by-side relation in which the module includes a backing sheet of material such as expanded metal having openings throughout which engage with a configured arcuate washer and stud to retain the module securely to the furnace wall. These modules may also be attached by a stud welding technique more fully described in U.S. Pat. No. 3,706,870 to Sauder et al, or an explosive impact type dry pin fastener.

U.S. Pat. No. 3,832,815 to Balaz et al. discloses modular ceramic fiber insulation in which each module is fabricated of layers of high temperature ceramic fiber blanket disposed substantially perpendicular to the hot face of the furnace lining. The layers are compressed during assembly into a resilient bundle. The layers are retained in modular form by pins threaded substantially perpendicularly through the blanket layers and disposed near the outer cold face of the module that is remote from the interior of the furnace. The ends of these pins extend through L-shaped elongated strips of expanded metal having a length corresponding to the width of the assembled strips. The retainer members are secured to the furnace wall by, for example, a plurality of pins which extend through the furnace shell.

U.S. Pat. No. 3,952,470 to Byrd, Jr. discloses modular ceramic fiber insulation wherein a folded insulating blanket of refractory fibrous material is provided with a support beam mounted lengthwise and embedded within a fold in the blanket to support the blanket, and a mounting means which includes suspension arm which extends through the folds of the blanket from the support beam to an attachment beam for mounting with the wall of the furnace. The attachment beam has openings formed therein for passage of connecting members therethrough to attach the attachment beam to the wall of the furnace. The main support beam is attached to the furnace wall in conventional manner, i.e. by welding or the use of screws, bolts and the like.

U.S. Pat. No. 4,339,902 to Cimochowski et al. discloses a modular thermal insulation formed of folded fibrous insulating blanket and a metallic attachment structure adapted to be secured to a wall of a furnace or the like. A bar is embedded in a fold of the blanket. The bar is attached by a connector to the main beam in the form of a C-shaped channel which is mounted to the furnace wall by first placing a flanged mounting clip against the furnace wall and thereafter sliding the C-shaped attachment means over the clip so that the flanges of the beam engage the flanges of the mounting clip.

U.S. Pat. Nos. 4,381,634 and 4,449,345 to Hounsel et al. discloses the refractory ceramic fiber blanket module having a continuous strip of ceramic fiber folded into a number of layers in serpentine fashion and retained in modular configuration by attachment hardware adapted for mounting on one surface of a furnace. Certain of the folds contains support rods which engage a perpendicularly extending support rod which penetrates a plurality of the layers of blanket adjacent the cold face folds to support the blanket in place when the module is installed. The support rods which penetrate the blanket layers also extend through the suspension tabs of a slide channel member which has a C-shaped cross-sectional configuration. The C-shaped slide channel slidingly engages a complimentary attachment member previously attached to the inner surface of the furnace.

U.S. Pat. No. 4,120,641 to Myles discloses a ceramic fiber module adapted to be welded to the furnace wall by use of a spherical attachment. The welding is performed from the inner or hot face surface of the module by reaching through the layers of ceramic fiber mats.

U.S. Pat. No. 4,287,839 to Severin et al. describes an insulating apparatus comprising blocks of insulation mat folded in corrugated manner which are penetrated below the extreme ends of the folds by carrying bars which are affixed to lugs that inturn are joined to a base plate having on opposite sides webs bent outwardly. These webs are provided with holes for the purpose of joining adjacent insulating blocks by bolts. The holding bars are affixed to the furnace wall or other support members by means of hooks.

U.S. Pat. No. 4,493,176 to Cimochowski discloses mounting means for thermal insulation modules which includes a rounded member adapted to fit into and cooperate with a C-shaped channel member attached to the insulation module. The rounded member itself is secured by a securing member to the wall of a furnace or like device. The mounting member allows the insulation module to be easily secured to the wall in sliding engagement even in locations of limited access.

U.S. Pat. No. 4,578,918 to Yost et al. discloses a means for securing fiber blanket insulation and modules to furnace walls comprising a pin attached to the wall of the furnace with an elongated aperture near its outer end through which extends a second rod of rectangular cross section the rod including a crimped mid-section. The crimped section and aperture are formed such that the rod can be inserted through the aperture to the crimp and then rotated ninety degrees to lock the retaining rod in position. The retaining rod penetrates substantially perpendicularly through the layers of ceramic fiber blanket.

U.S. Pat. No. 3,687,093 to Byrd, Jr., discloses a furnace lining which is anchored by a tubular ceramic anchor and a metal bushing fitted therein secured by welding or other means to the metal wall of the furnace. The tubular anchor includes adjacent its inner end an inwardly flared portion which is engaged by the outer surface of a complementary configured metal bushing. Access to the furnace for welding is provided via the opening in the tubular ceramic anchor. Following installation the bore of the anchor is plugged with suitable ceramic refractory.

U.S. Pat. No. 3,742,670 to Byrd, Jr., discloses a thermal insulation construction in which a stud member is welded onto the furnace shell, insulation lining is placed over the projecting stud, and the hot end of the stud is protected by a refractory protector of cup-like shape retained by a holding nut. The cup is filled with cast refractory mixture sufficient to completely fill the cap and cover the holding nut and end of the stud.

U.S. Pat. No. 4,379,382 to Sauder discloses an insulation module which carries a fastener actuated by introducing a tool through the hot face of the module, or a fastener introduced into the module and actuated through the hot face at the time of module installation. Of particular note are FIGS. 2 and 6. The fastener may be a weld on type such as that disclosed in U.S. Pat. No. 3,706,870 or a screw or bolt. A stud gun such as that disclosed in U.S. Pat. No. 4,032,742 may be inserted into the hot face of the module to engage the stud assembly and thereafter tighten a nut onto the threaded stud. The fastener may carry a removable sleeve portion covering the nut which is manually removed from the stud assembly through the hot face of the module following attachment.

U.S. Pat. No. 4,478,022 discloses an insulation attachment system similar to that described in regard to U.S. Pat. No. 4,578,918 except that the insulation lock retaining pins are notched mid way thereof to cooperate with an aperture in the end of this previously welded stud. The retaining pin is passed through the aperture of the stud and rotated to provide an interlock with the notched portion of the pin with the aperture of the stud.

U.S. Pat. No. 4,516,374 to Finney discloses a ceramic fiber blanket insulation module which is secured to the furnace wall by a pair of retainer bar supports each having first and second ends with the first end being adapted to be secured to a furnace wall at spaced apart locations, an elongated retainer bar which is adapted to extend laterally through the module and engage with the free ends of the retainer bar supports. The modules are held in generally trapazoidal configuration by a protective cover which facilitates installation by facilitating access to the previously installed retainer bar mounting brackets.

U.S. Pat. Nos. 3,819,468, and 4,574,995 to Sauder et al. discloses a ceramic fiber insulation module which may be attached to the furnace wall through use of a stud welding gun inserted through the exposed hot face of the module.

Advertising literature of unknown date published by Babcock and Wilcox, describes ceramic fiber insulation modules identified as Saber Bloc TM, Saber Bloc TM II, Kao-Bloc, Saber Sections TM and Uni-Bloc and Pyro Bloc TM module. The Pyro Bloc TM "Y" module includes a U-shaped yoke assembly having at the end of each leg thereof an aperture for receipt of a retaining rod which passes through the ceramic fiber insulation. The central or bottom portion of the yoke includes an aperture for receipt of a threaded fastener which is pre-affixed to a torque tube which extends to the hot face of the module.

U.S. Pat. No. 4,494,295 to Herring discloses a method for attaching refractory ceramic fiber modules to steel furnace shells. Metal brackets are welded to the furnace wall. A loop on the free end of each bracket receives pointed steel rods which impale the modules to secure them to the furnace wall.

U.S. Pat. No. 4, 549,382 to Byrd, Jr., discloses a ceramic fiber blanket insulation module and a structure for attaching the module to the surface of a furnace. The attaching structure includes a suspension arm member for receiving a support rod which passes through the layers of ceramic fiber blanket. A locking lug structure is provided for locking the suspension arm member to the mounting structure while providing perceptible indication to the installer that positive locking engagement has been obtained by sliding motion of the hardware which is a part of the module relative to that hardware previously attached to the furnace wall in conventional manner, i.e., by bolts or welding.

Other examples of modular ceramic fiber insulation include U.S. Pat. No. 3,819,468 to Sauder et al.; U.S. Pat. No. 3,854,262 to Brady; U.S. Pat. No. 3,892,396 to Monaghan; U.S. Pat. No. 4,001,996 to Byrd, Jr.,; U.S. Pat. No. 4,055,926 to Byrd, Jr.,; U.S. Pat. No. 4,086,737 to Byrd, Jr.,; U.S. Pat. No. 4,103,469 to Byrd, Jr.,; U.S. Pat. No. 4,123,886 to Byrd, Jr.,; U.S. Pat. No. 4,218,962 to Cunningham et al.; U.S. Pat. No. 4,574,995 to Sauder et al.; U.S. Pat. No. 4,429,504 to Hounsel et al.

SUMMARY OF THE INVENTION

There is provided according to an aspect of the present invention attachment hardware adapted for mounting an insulation module on a surface, said module including a hot face adapted to be presented to the interior of a furnace and a cold face adapted to be presented to a surface of a furnace, the hot face and cold face defining between them a module thickness, a pair of side faces which between them define a module length and a top face and a bottom face which between them define a module width, said hardware comprising:

(a) A base bar adapted to extend along some portion of the module length and width, said base bar including a slot formed therein extending in the direction of the length of the base bar;

(b) At least one tine depending from the base bar toward the hot face, said tine having an aperture therein adjacent its end distal from the base bar;

(c) A collar of tubular configuration depending from the base bar toward the hot face, said collar including a pair of diametrically opposed flanges which retain the collar in sliding engagement with the base bar;

(d) An extension tube having an outside diameter complementary to the inside diameter of the collar, the tube being fitted into the collar and projecting generally perpendicularly from the base bar toward the hot face;

(e) Support rod means received in said aperture of said tine, and adapted to extend longitudinally through at least some portion of the length of the module.

According to another aspect of the present invention there is provided a refractory ceramic fiber module for insulating a surface, such as a wall of a furnace, said module including a hot face adapted to be presented to the interior of a furnace and a cold face adapted to be presented to a surface of the furnace such as wall of the furnace, said hot face and said cold face defining between them a module thickness, a pair of side faces which between them define a module length, and a top face and a bottom face which between them define a module width, said module comprising:

(a) A refractory ceramic fiber insulating member which also defines the hot face, side faces, top face and bottom face of the module and partially defines the cold face of the module;

(b) A base bar extending along a portion of the length and width of the module proximate the cold face; said base bar having a slot formed therein extending in the direction of the length of the base bar;

(c) At least one tine depending from the base bar generally perpendicularly thereto into the ceramic fiber member toward the hot face for a predetermined distance in the direction of the thickness of the ceramic fiber module intermediate said two side faces and said top face and said bottom face;

(d) A tubular collar including a pair of diametrically opposed flanges which engage in slidable fashion the base bar over the slot;

(e) an extension tube having an outside diameter complementary to the inside diameter of said collar, one end of said tube being received in said collar, the distal end of said tube being proximate the hot face; said tube and said collar being moveable as an assembly along the base bar commensurate with the length of the slot in the base bar.

According to another aspect of the present invention there is provided attachment hardware adapted for mounting an insulation module on a surface, said module including a hot face adapted to be presented to the interior of a furnace and a cold face adapted to be presented to a surface of a furnace, the cold face and hot face defining between them a module thickness, a pair of side faces which between them define a module length and a top face and a bottom face which between them define a module width, said hardware comprising:

(a) a base bar adapted to extend along some portion of the module length and width, said base bar including a slot extending in the direction of the length of the base bar, said base bar being in the form of a channel shaped member having spaced apart sidewall members;

(b) a pair of tines depending from said base bar at spaced apart locations predetermined relative to the ends of the slot in the base bar toward the hot face, each said tine having an aperture therein adjacent its end distal from said base bar;

(c) an extension tube having an outside diameter complementary to the inside dimension between the sidewall members of the base bar, said tube being fitted into abutting relationship with the channel shaped member to contact the bottom central portion thereof over the slotted area, said extension tube projecting generally perpendicularly from the base bar toward the hot face;

(d) support rod means received in each said aperture of said tines, and adapted to extend longitudinally through at least some portion of the length of the module.

According to another aspect of the present invention thre is provided attachment hardware adapted for mounting an insulation module on a surface, said module including a hot face adapted to be presented to the interior of a furnace and a cold face adapted to be presented to a surface of a furnace, the hot face and cold face defining between them a module thickness, a pair of side faces which between them define a module length and a top face and a bottom face which between them define a module width, said hardware comprising;

(a) a base bar adapted to extend along some portion of the module length and width;

(b) at least one pair of spaced apart tines, each tine depending from the base bar toward the hot face, each said tine having an aperture therein adjacent its end distal from the base bar;

(c) a collar of generally tubular configuration depending from the base bar toward the hot face, said collar including flange means having an aperture therein coacting with the base bar to retain the collar in sliding engagement with the base bar, said collar further including a foot member having an aperture therein depending toward the cold face generally parallel thereto;

(d) an extension tube having an outside diameter complementary to the inside diameter of the collar, the tube being fitted into the collar and projecting generally perpendicularly from the base bar toward the hot face;

(e) support rod means received in each of said apertures of said tines, and adapted to extend longitudinally through at least some portion of the length of the module.

BRIEF DESCRIPTION OF THE DRAWINGS

The invention will be more particularly described as to its preferred embodiments by reference to the accompanying drawing in which like parts are numbered alike.

FIG. 1A is a fragmentary enlarged elevational view taken along the plane indicated by line 1A—1A of FIG. 1.

DESCRIPTION OF PREFERRED EMBODIMENTS

Figure 1:
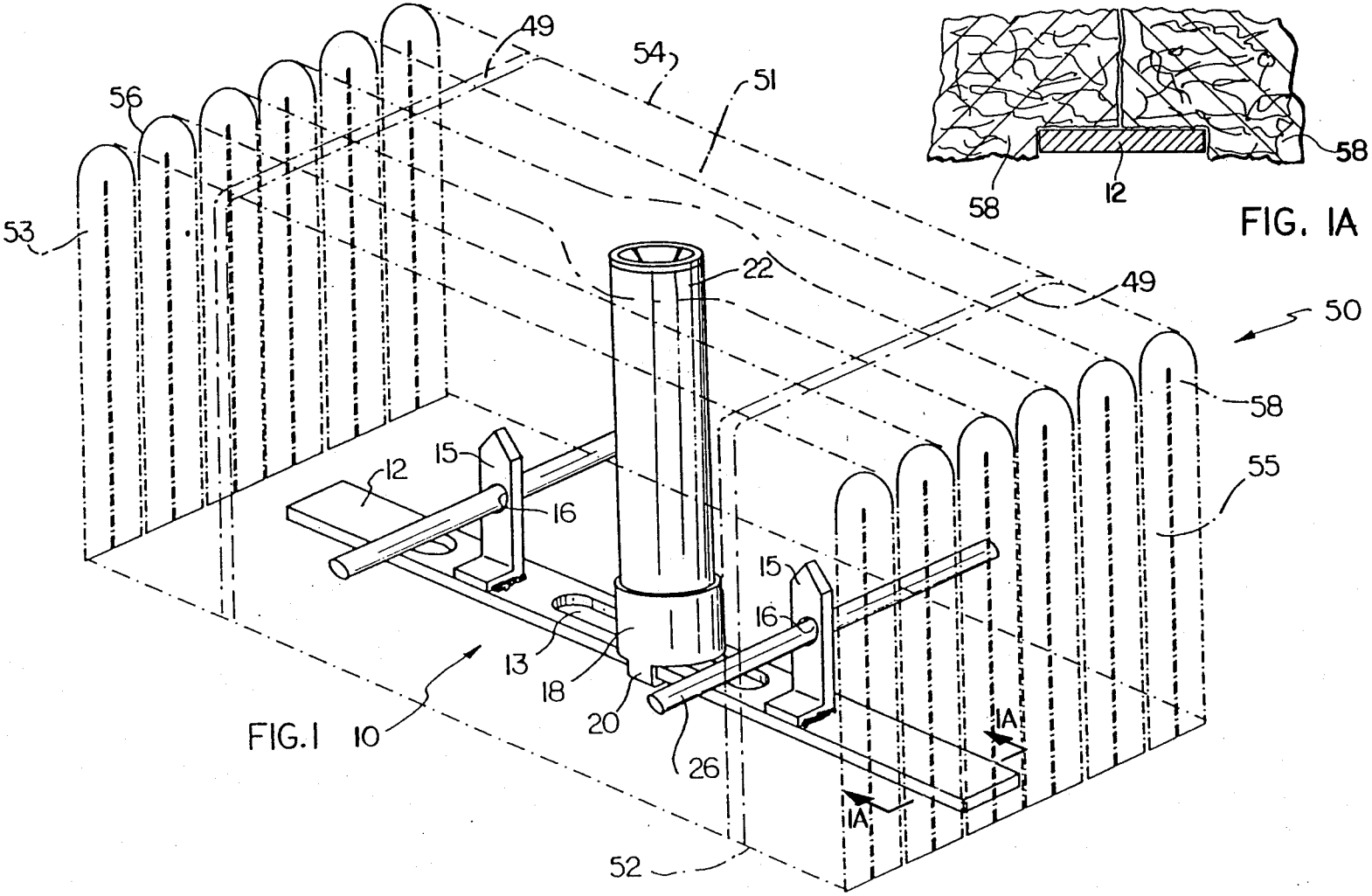
FIG. 1 is an isometric view partially broken away illustrating a preferred embodiment of the hardware system and module according to the invention.

A first and highly preferred embodiment according to the present invention of attachment hardware and a module incorporating such attachment hardware is shown in FIG. 1. The attachment hardware, depicted generally by numeral 10, is adapted for mounting an insulation module depicted generally by numeral 50 on a surface (not shown) such as that of a furnace, kiln or the like. Module 50 includes a hot face 51 adapted to be presented to the interior of a furnace, kiln or the like. Module 50 includes a cold face 52 adapted to be presented to a surface of a furnace kiln or the like. Hot face 51 and cold face 52 define between them a module thickness. Module 50 also includes a pair of side faces 53 and 54 which between them define a module length. Module 50 also includes a top face 55 and a bottom face 56 which between them define a module width. Module 50 includes a refractory ceramic fiber insulating member formed from an array of ceramic fiber mats 58 together with attachment hardware 10.

The attachment hardware 10 depicted in FIG. 1 includes a base bar 12 which is adapted to extend along some portion of the length and width of Module 50. Base bar 12 has formed therein slot 13 which extends in the direction of the length of the base bar. In the preferred embodiment shown in FIG. 1 tines 15 depend generally perpendicularly from the base bar toward the hot face 51. Tines 15 may be secured to the base bar by spot welding. Each of tines 15 includes an aperture 16 adjacent the end of the tine which is distal the base bar 12. Received in the aperture 16 of each tine 15 is a support rod means 26 which is adapted to extend longitudinally throughout at least some portion of the length of the Module 50.

When the attachment hardware is to be utilized as a part of a ceramic fiber insulation module, the length of support rod means 26 is preferably the same as or slightly less than the module length. It is preferable to dimension the support rod means 59 such that the length is slightly less, e.g. $\frac{1}{4}$ to $\frac{1}{2}$ inch total, than the overall length of the array or stack of ceramic fiber mats which is penetrated thereby. The ceramic fiber mats 58 and particularly those ceramic fiber mats adjacent the side faces 53 and 54, respectively, of Module 50 are held in position prior to installation of the module by thermally decomposable bands 49. Common Plastic strapping may be employed for this purpose. Bands 49 are preferably removed after installation of the module prior to heating of the furnace, kiln or the like. However, bands 49 may be left in place to decompose upon initial firing of the furnace.

Figure 2:
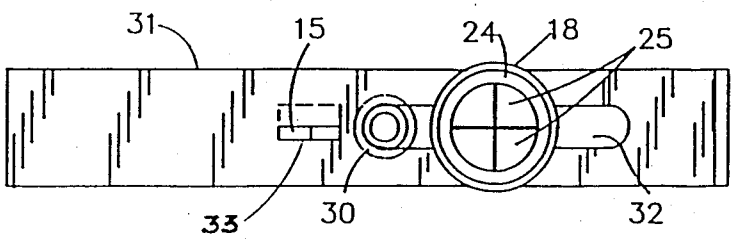
FIG. 2 is a plan view of an alternate embodiment of attachment hardware according to the invention.
Figure 3:
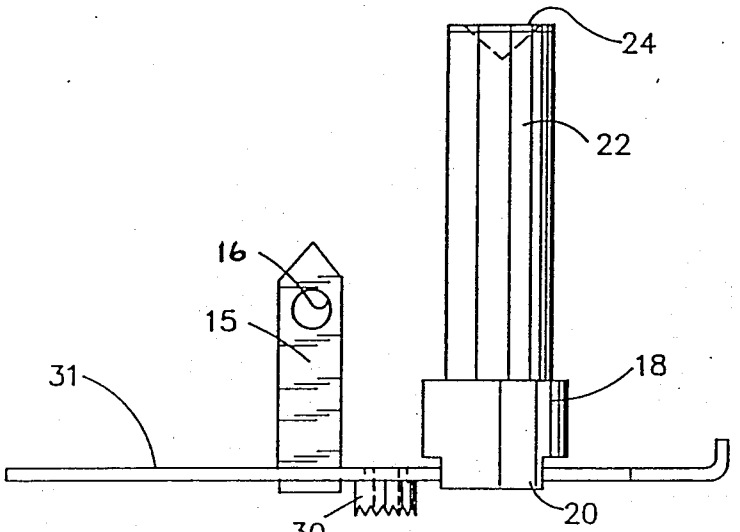
FIG. 3 is an elevation view of the attachment hardware shown in FIG. 2.
Figure 4:
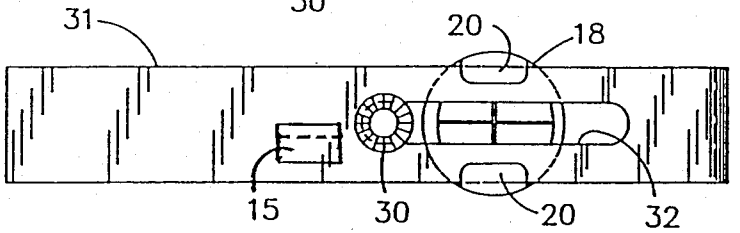
FIG. 4 is a bottom view of the attachment hardware shown in FIGS. 2 and 3.

Attachment hardware 10 additionally includes a collar 18 of tubular configuration. Collar 18 is affixed to base bar 12 but is free to slide in the lengthwise direction of base bar 12. A pair of diametrically opposed flanges 20 retain collar 18 on base bar 12. The configuration of collar 18 and its manner of engagement with the base bar are also depicted in FIGS. 2, 3 and 4. As an alternate embodiment not shown, flanges may be reversed so as to extend through slot 13 of the base bar 12 and coact with the inside edges of slot 13 rather than engaging the outermost edges of the base bar.

Attachment hardware 10 also includes an extension tube 22 having an outside diameter complementary to that of the inside diameter of slidable collar 18. Tube 22 is fitted into collar 18 and projects generally perpendicularly from base bar 12 toward hot face 51. The length of the tube 22 is preferably such that when the module is manufactured and the tube 22 is bottomed in collar 18, the tube extends nearly to the hot face 51. Typically the end of the tube 22 nearest hot face 51 is flush with the hot face so that ceramic fiber mats 58, which are resilient, do not expand over the end of the tube and block view of or access to the end of the tube by a person looking at the hot face.

FIGS. 2, 3 and 4 depict attachment hardware differing from that shown in FIG. 1 principally by having only a single tine 15 which projects generally perpendicularly from base bar 31. As in the embodiment shown in FIG. 1, collar 18 is in sliding engagement with the base bar 31. The embodiment of FIGS. 2 through 4 additionally includes a welding arc shield 30 which is retained at that end of slot 32 formed in base bar 31 which is nearest tine 15. The dimensions and location of tine 15, base bar 31, and collar 18 are predetermined such that when collar 18 is slid into abutting relationship with tine 15 collar 18 is centered over welding arc shield 30. This feature facilitates installation of the attachment hardware or modules utilizing the attachment hardware of the present invention through use of a stud-welding gun such as that described in U.S. Pat. No. 4,032,742 Welding arc shield 30 could, of course, also be fitted to other embodiments of the present invention. Welding arc shield 30 may be secured in the slot in base bar by cementing or by friction. The end of base bar 31 distal tine 15 is bent out of the plane of the remainder of the base bar up to prevent accidental disengagement of collar 18.

In preferred embodiments of the invention which are intended for use with a stud welding gun, the attachment hardware and module additionally include a bushing 24 mounted to the end of extension tube 22 which is nearest the hot face. Bushing 24 includes resilient members 25 which project radially inwardly toward the center of the bushing. Resilient members 25 of bushing 24 function to aid in centering an installation tool such as a welding gun which may be employed to install the attachment hardware or modules according to the invention. Bushing 24 may be formed of any suitable material such as plastic or metal.

In preferred embodiments the inside diameter of extension tube 22 is selected so as to correspond to the outside dimension of a stud-welding gun or screw gun adapted to be used therewith. Extension tube 22 may be formed of any suitable material such as paper, plastic or metal. Bushing 24 may be secured by friction to the end of extension tube 22.

Figure 5:
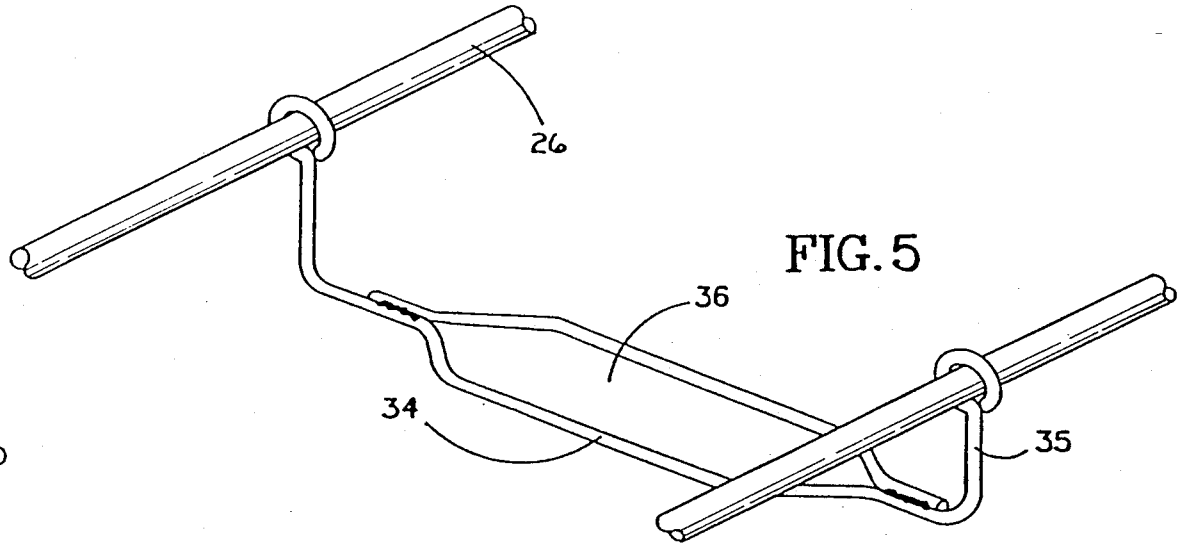
FIG. 5 is an isometric view of an alternate embodiment of attachment hardware according to the invention.

In FIG. 5 there is shown another embodiment of attachment hardware according to the invention. The attachment hardware includes base bar 34 whose ends are bent to form tines 35 each having an aperture formed therein for receipt of support rod means 26 comparable to those shown in FIG. 1. The base bar 34 and tines 35 are formed by bending wire into the configuration shown such that tines 35 project generally perpendicularly relative to base bar 34. A slot 36 is formed by adding another appropriately formed piece of wire and welding it in position. Alternatively, the wire could be doubled back within one of the tines 35 along the base bar 34 to form slot 36.

Figure 6:
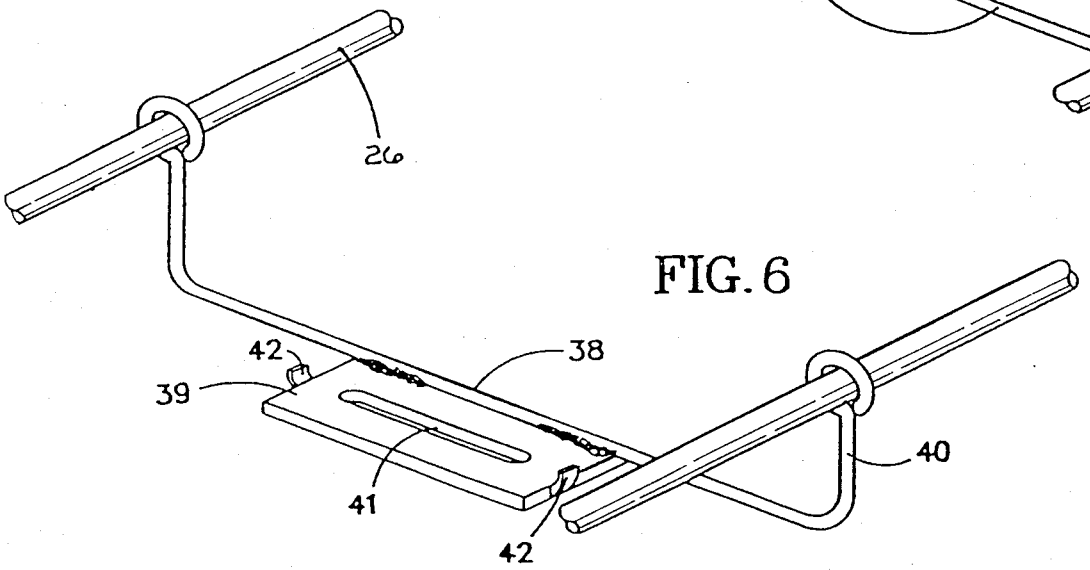
FIG. 6 is an isometric view illustrating an alternate embodiment of attachment hardware according to the invention.

In FIG. 6 there is shown another embodiment of attachment hardware according to the present invention. Base bar 38 and tines 40 are formed of a single length of heavy wire, the ends of which are bent so as to project generally perpendicularly relative to the lengthwise direction of the central portion to form tines 40. A flat-plate 39 including a slot 41 is welded to base bar 36. Stop means in the form of Tabs 42 are provided to limit sliding motion of collar such as collar 18 and FIG. 1.

Attachment hardware according to the present invention may also be formed by taking a piece of flat metallic strip and turning up the ends thereof and rotating them ninety degrees to form the tines. The central portion of the metallic strip is provided with a slot to coact with collar 18 and each of the tine portions with an aperture to receive support rod means 26.

Figure 7:
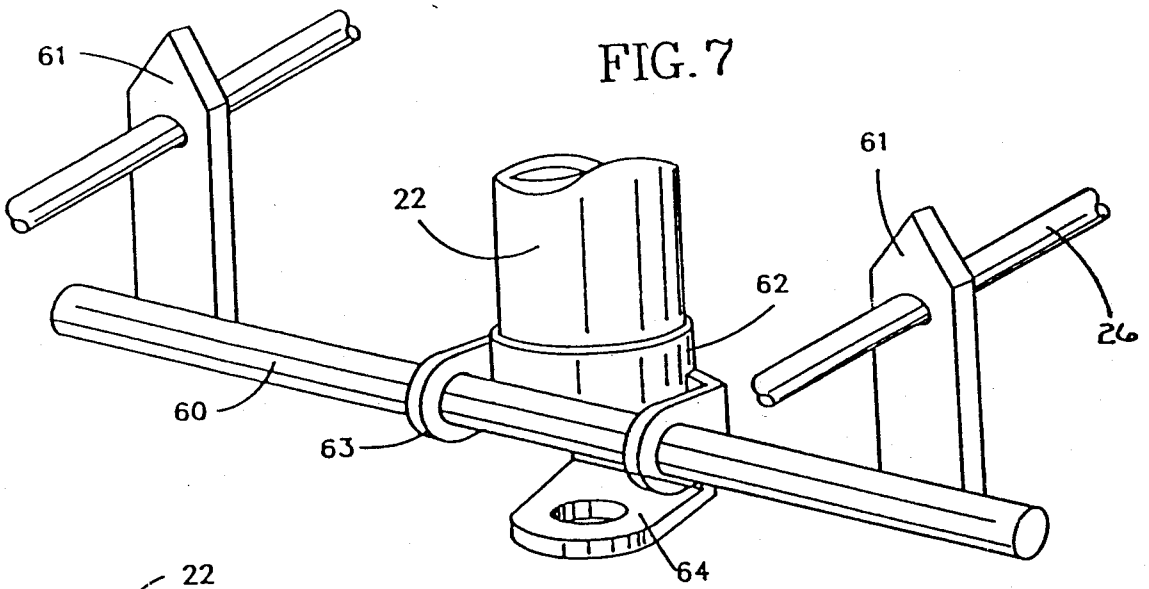
FIG. 7 is an isometric view of an alternate embodiment of attachment hardware according to the invention.

In FIG. 7 there is shown another embodiment of attachment hardware according to the present invention. Base bar 60 is in the form of a straight cylindrical member. It may be formed of heavy gauge wire, solid rod or a hollow tubular member. Tines 61 are attached to the base bar 61 at spaced apart locations in substantially the same plane. Each of tines 61 includes an aperture adjacent that end of the tine which is distal base bar 60 for receipt of a support rod means such as support rod means 26 shown in FIG. 1. The embodiment of FIG. 7 also includes collar 62 which includes flange means 63 having apertures therein which are arranged such that collar 62 may slide in the lengthwise direction of base bar 60 between tines 61. Collar 62 also includes foot member 64 having an aperture therein for receipt of a fastener (not shown) to be used to secure the attachment hardware to the surface of a furnace or the like. The aperture in foot member 64 may be fitted with a welding arc shield such as that depicted by numeral 30 in FIGS. 2, 3 and 4. The combined features of base bar 60 and collar 62 provide an equivalent function to slideable tubular collar 18 of FIG. 1 and its corresponding base bar 12 having slot 13 therein.

Figure 8:
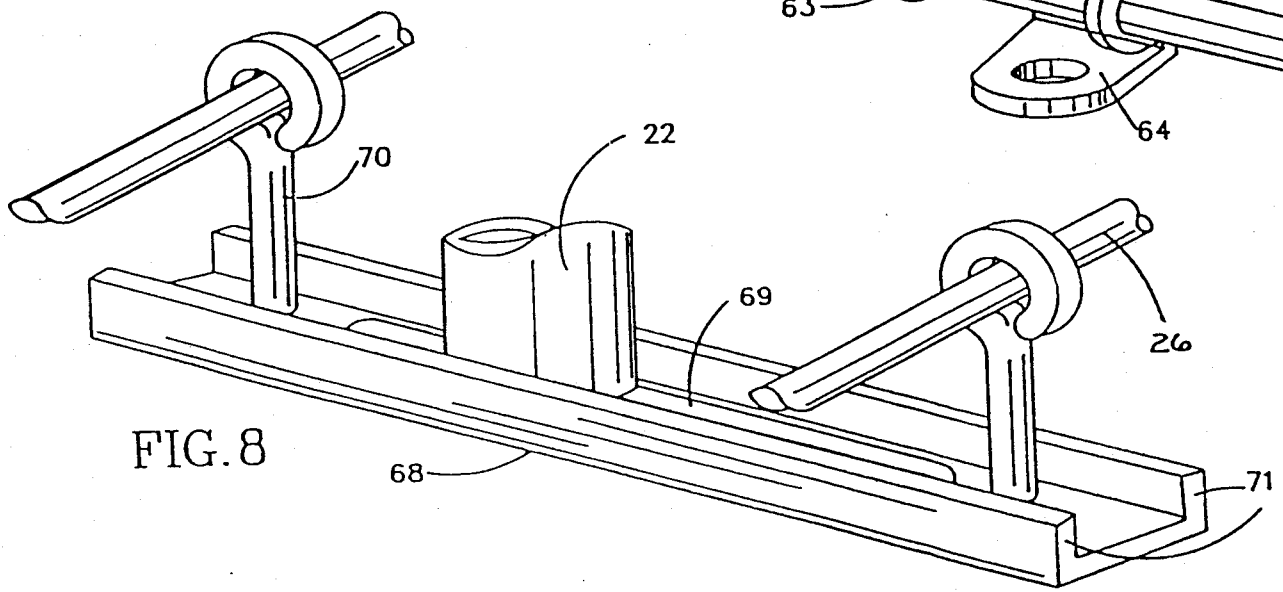
FIG. 8 is an isometric view of an alternate embodiment of attachment hardware according to the invention.

In FIG. 8 there is shown another embodiment of attachment hardware according to the present invention. Base bar 68 is formed of a single length of channel-shaped member. Base bar 68 has formed therein slot 69 which extends in the direction of the length of the base bar. A tine 70 is affixed to the base bar beyond each end of slot 69. Each of tines 70 depends from the base bar 68 generally perpendicularly to define a plane generally perpendicular to the central bottom section of base bar 68. Each of tines 70 includes an aperture at its end distal base bar 68 which is adapted to receive support rod means such as numeral 26 shown in FIG. 1. Sidewall members 71 of base bar 68 and tines 70 cooperatively function to act as guide members to limit movement of extension tube 22 to be that of sliding motion in the lengthwise direction of base bar 68. Extension tube 22 may be identical to that depicted in FIG. 1. Alternately an extension tube may be provided having frangible or resilient flanges which coact with base bar similar to that shown in FIG. 1 to retain the extension tube in sliding engagement with the base bar during installation of the hardware or module. In the embodiment shown in FIG. 8 extension tube 22 may be withdrawn by pulling it in the direction of its length, perpendicularly away from base bar 68.

The base bar, tines, tubular sliding collar, and rods of attachment hardware and modules according to the invention are formed of suitable material chosen on the basis of intended service conditions. A preferred material for many applications is type 304 stainless steel. The base bar, tines and support rods must be of material that will provide sufficient high temperature resistance and corrosion resistance in order to provide service life commensurate with that of the ceramic fiber or other insulating material which is secured to the furnace by the attachment hardware. Materials suitable for the sliding collar, extension tube and bushing need only be sufficient to withstand conditions encountered during manufacture and installation of the module as they serve no structural purpose following installation. The extension tube and bushing are removed followed installation or decomposed upon initial firing of the furnace.

In the most highly preferred embodiments tine 15 is of L-shaped configuration as shown in FIGS. 1 through 4. For added security, in FIGS. 2, 3 and 4, tine 15 is inserted into an aperture 33 formed in the base bar 31 from the cold face side of the base bar. This results in mechanical restraint of the tine 15 to the base bar 31 when the hardware is installed against the surface of a furnace or the like rather than depending solely on bonding or welding as shown in FIG. 1.

As shown in FIGS. 1 and 1A, the base bar 12 of Module 50 is preferably recessed a slight amount, for example ⅛ to 3/16 of an inch relative to the cold face 52 of the module so that upon installation of the module the ceramic fiber mats 58 form a perimeter seal around the attachment hardware 10 and against the surface to which the module and attachment hardware are secured.

The ceramic fiber member may be formed of mat folded into U-shaped configuration such as those depicted by numeral 58 in FIG. 1. Alternatively, the ceramic fiber member may be a stacked array of planar ceramic fiber mats which contain no folds, or be formed of mat folded in corrugated or serpentine manner, or be formed of mats of U-shaped configuration with the folded portion of each mat being adjacent the cold face of the module rather than the hot face of the module as depicted in FIG. 1, or combinations of the foregoing.

Attachment hardware of the present invention may also be employed with rigid ceramic refractory members (not shown) such as boards or blocks which themselves are formed from ceramic fibers or other refractory material. When rigid blocks are utilized it is necessary to form or machine the blocks so as to accommodate the slideable motion of the tubular collar on the base bar to take full advantage of the features of the present attachment hardware. Following securement of the hardware and module to a surface and withdrawal of the extension tube and bushing from tubular collar the resulting recess is filled with a fiber and/or a refractory moldable or castable mix such as LDS Moldable TM available from Standard Oil Engineered Materials Company, Fibers Division, Niagara Falls, N.Y. These materials are more fully described in U.S. Pat. Nos. 4,174,331, and 4,248,752.

When ceramic fiber mats such as those depicted by numeral 58 in FIG. 1 are employed, after securement of the module to a surface, extension tube 22 including bushing 24 if present, is withdrawn from tubular sliding collar 18 and the resilient ceramic fiber mat 58 fills the volume previously occupied by tube 22. Light tamping by the installer may be desired to encourage complete take up of this volume with ceramic fiber.

Support rod means 26 secure the ceramic fiber mats 58 to the tines 15 in FIGS. 1 through 4, 35 in FIG. 5 and 40 in FIG. 6. In a preferred embodiment support rod means 26 are formed of tubular stainless steel. These tubes may be seamless or formed by rolling flat sheet stock into tubular form. The rods are retained by friction in the ceramic fiber mats. This frictional force is increased upon installation of module 50.

For extreme environments support rod means may be formed entirely or in part of ceramic material. The hollow tubular steel rods previously described may include a ceramic insert to provide retention of structural stiffness at temperatures which would otherwise soften the metal and allow the support to distort. In like manner, tines may be formed of ceramic materials for such environments.

The attachment hardware of the present invention may be installed by any one of a variety of methods. It may be installed by inserting a screw gun previously loaded with a self-tapping screw into extension tube 22 to drive the self-tapping screw into the shell of the furnace or the like through tubular collar 18 and slot 13 in base bar 12. If the self-tapping screw is threaded into the furnace shell but is not run down completely the attachment hardware permits the module to be shifted in position along the surface to which it is being affixed because tubular collar 18 and extension tube 22 are free to slide as an assembly relative to base bar 12 and ceramic fiber mats 58. This feature facilitates proper installation wherein the modules are in firm abutting relationship with their neighbors without need of highly skilled labor. The attachment hardware and module of the present invention may also be installed by inserting a stud-welding gun into extension tube 22 and sliding collar 18. After insertion the tube and collar is slid as an assembly along base bar 12 to the limit of sliding movement. At this point collar 18 is in abutting relationship with tine 15 and thus automatically aligned with welding arc shield 30. The stud-welding gun is thereupon cycled and withdrawn and extension tube 22 withdrawn. The module and attachment hardware of the present invention may also be employed with previously installed studs. Again, installation is facilitated because the installer has visual indication at all times because of visual contact with the stud by peering through extension tube 22 into the opening in the base bar and collar. After the attachment hardware/module is inserted over the pre-attached threaded stud it is a simple matter to run a nut onto the stud. In this circumstance, also, the sliding feature of the present hardware allows a degree of re-positioning of the module. This eliminates requirement for a high degree of precision in placement of the studs which is necessary in prior art systems.

Should a module utilizing the hardware of the present invention become damaged, it may be readily replaced as follows. The ceramic fiber of the damaged module is torn away to expose the attachment hardware and surface to which the hardware is attached. The old attachment hardware may then be removed as appropriate, i.e., by unscrewing or breaking the weld. If a prewelded threaded stud was employed a new module may then be installed over the same stud. Alternatively, the new module may be affixed using a self-tapping screw or by a power actuated stud which penetrates the furnace surface, or to a prepositioned fastener or by welding into position using a tool inserted from the hot face through the thickness of the module.

The foregoing description and embodiments are intended to illustrate the invention without limiting it thereby. It will be understood that various modifications can be made in the invention which are obvious from the preferred embodiments which have been described in detail. These variations are intended to be included within the present specification and claims. Examples of such variations are the following. The attachment hardware need not be recessed when viewed from the cold face of the module. The number of tines affixed to a single base bar may be increased as required to meet expected service conditions. The base bar may include two or more spaced apart slots with a sliding collar and extension tube affixed to each. A module may include two or more hardware sets. In this manner large modules may be made. The base bar may be of a length commensurate with the distance between the top face and bottom face of the module or may be of a shorter length as shown in the preferred embodiment of FIG. 1. The base bar and cold face of a module may be configured to complement the surface to be insulated. For example, they may be curved or configured to define a corner. The attachment hardware of the present invention may be used in combination with spray-applied ceramic fiber insulation such as that described in U.S. Ser. No. 770,333 filed Aug. 26, 1985, which is hereby incorporated by reference. The plane defined by the tines and that defined by the sliding motion of the center line of the sliding collar in its slot need not be in the same plane.

What is claimed is:

1. Attachment hardware adapted for mounting an insulation module on a surface, said module including a hot face adapted to be presented to the interior of a furnace and a cold face adapted to be presented to a surface of a furnace, the cold face and hot face defining between them a module thickness, a pair of side faces which between them define a module length and a top face and a bottom face which between them define a module width, said hardware comprising:

(a) a base bar adapted to extend along some portion of the module length and width, said base bar including a slot extending in the direction of the length of the base bar, said base bar being in the form of a channel shaped member having spaced apart sidewall members;

(b) a pair of tines depending from said base bar at spaced apart locations predetermined relative to the ends of the slot in the base bar toward the hot face, each said tine having an aperture therein adjacent its end distal from said base bar;

(c) an extension tube having an outside diameter complementary to the inside dimension between the sidewall members of the base bar, said tube being fitted into abutting relationship with the channel shaped member to contact the bottom central portion thereof over the slotted area, said extension tube projecting generally perpendicularly from the base bar toward the hot face;

(d) support rod means received in each said aperture of said tines, and adapted to extend longitudinally through at least some portion of the length of the module.

2. Attachment hardware adapted for mounting an insulation module on a surface, said module including a hot face adapted to be presented to the interior of a furnace and a cold face adapted to be presented to a surface of a furnace, the hot face and cold face defining between them a module thickness, a pair of side faces which between them define a module length and a top face and a bottom face which between them define a module width, said hardware comprising;

(a) a base bar adapted to extend along some portion of the module length and width;

(b) at least one pair of spaced apart tines, each tine depending from the base bar toward the hot face, each said tine having an aperture therein adjacent its end distal from the base bar;

(c) a collar of generally tubular configuration depending from the base bar toward the hot face, said collar including flange means having an aperture therein coacting with the base bar to retain the collar in sliding engagement with the base bar, said collar further including a foot member having an aperture therein depending toward the cold face generally parallel thereto;

(d) an extension tube having an outside diameter complementary to the inside diameter of the collar, the tube being fitted into the collar and projecting generally perpendicularly from the base bar toward the hot face;

(e) support rod means received in each of said apertures of said tines, and adapted to extend longitudinally through at least some portion of the length of the module.

* * * * *